US005762571A

United States Patent [19]

DeGaris

[11] Patent Number: 5,762,571

[45] Date of Patent: Jun. 9, 1998

[54] ULTRA THIN RACQUET FRAME

[76] Inventor: Kenneth Godfrey DeGaris, P.O. Box 267, Carlingford, NSW 2118, Australia

[21] Appl. No.: 586,802

[22] PCT Filed: Aug. 5, 1994

[86] PCT No.: PCT/AU94/00447

§ 371 Date: May 1, 1996

§ 102(e) Date: May 1, 1996

[87] PCT Pub. No.: WO95/04576

PCT Pub. Date: Feb. 16, 1995

[51] Int. Cl.[6] ..... A63B 49/02

[52] U.S. Cl. ..... 473/537

[58] Field of Search ..... 473/521, 524, 473/537

[56] References Cited

U.S. PATENT DOCUMENTS 1,539,019 5/1925 Nikonow ..... 473/73 R 4,165,071 8/1979 Frolow ..... 473/521

5,037,098 8/1991 Davis ..... 473/521

5,183,265 2/1993 Umlauft et al. ..... 473/521

*Primary Examiner*—William E. Stoll

*Attorney, Agent, or Firm*—Edwin D. Schindler

[57] ABSTRACT

A tennis racquet (1) is disclosed. The racquet (1) comprises a handle (3) having a free end (6), a racquet head (2) having a loop frame (7), a throat (4) connecting the racquet head (2) to the handle (3) with the loop frame (7) having a first half (9) remote from the handle (3) and a second half (10) being closer to the handle (3). A mid-section (15) of the racquet (1) extends from and includes the second half (10) of the loop frame (7) and the throat (4), to a point approximately 20 centimeters from the free end of the handle (3), characterized in that the thickness of the racquet (1) of any part of the mid-section (15) is less than 12 millimeters or 60% of the maximum thickness of the first half (9) of the racquet head (2).

3 Claims, 2 Drawing Sheets

ULTRA THIN RACQUET FRAME

The present invention relates to tennis racquets and, in particular, to a tennis racquet which has a relatively thin frame in the deemed mid-section of the racquet when compared to the thickness of the frame of the other sections of the racquet. As used in this specification the thickness of the frame of the racquet is the dimension measured from the front and back faces of the frame at any given point.

BACKGROUND TO THE INVENTION

Tennis racquets have normally had medium to relatively thick frames providing support around their head and mid-section. However, with the advent of newer and stronger materials it is believed that superior performance characteristics such as increased control and manoeuvrability can be achieved over the normal performance characteristics of existing racquets if thinner frames are used. It is the aim of this invention to provide performance characteristics which are superior to those of existing racquets. In addition tennis racquets with an ultra thin portion of its frame will also allow the creation of more spin on shots, provide less wind resistance which enhances swing speeds and greatly reduces racquet vibration and shock upon impact with a ball, which in turn, reduces the occurrence of arm and related injuries.

These advantages can be accomplished by means of the invention described herein. Thus it has been found advantageous to provide a tennis racquet which has an ultra thin portion of its frame.

OBJECT OF THE INVENTION

The present invention has therefore been conceived out of the need to provide a tennis racquet which provides superior performance characteristics. At the very least, the invention provides an alternative to known tennis racquet construction.

DISCLOSURE OF THE INVENTION

According to one aspect of the present invention there is provided a tennis racquet comprising a handle having a free end, a racquet head defined by a loop frame, a bridge that defines a portion of the closed loop frame of the racquet head, a throat connecting the racquet head to the handle, and the loop frame having a first half remote from the handle and a second half being closer to the handle, wherein a mid-section of the racquet extends from and includes the second half of the loop frame and the throat, to a point approximately 20 centimeters from the free end of the handle, characterised in that the thickness of the racquet of any part of the mid-section is less than approximately 60% of the maximum thickness of the racquet in the first half of the loop frame.

The loop frame of the racquet can either be a closed loop frame or an open loop frame.

BRIEF DESCRIPTION OF THE DRAWINGS

Some embodiments of the present invention will now be described with reference to the drawings in which.

BEST MODE OF CARRYING OUT THE INVENTION

Figure 1:
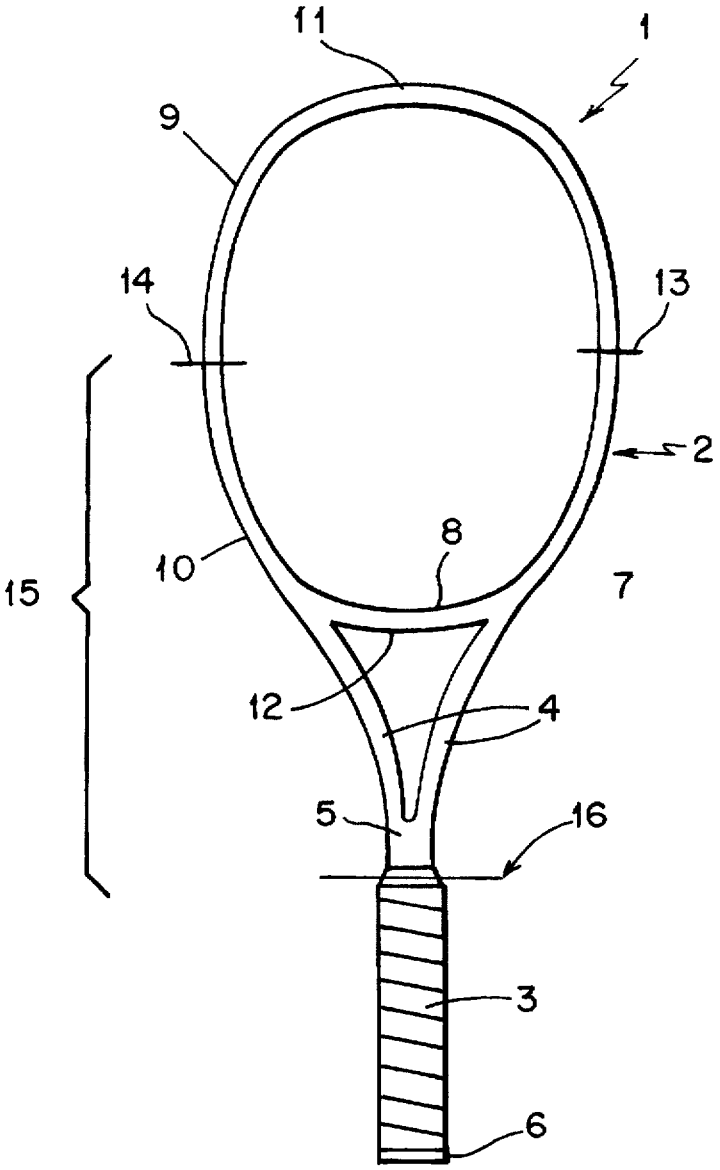
FIG. 1 is a face view of a games racquet of a first embodiment.
Figure 2:
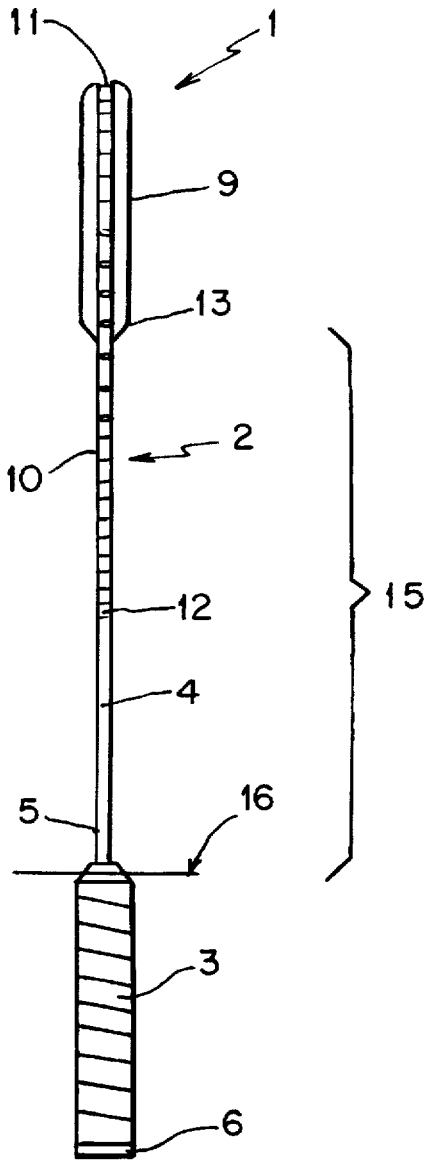
FIG. 2 is a side view of a games racquet of FIG. 1.

A tennis racquet 1 of a first embodiment is illustrated in FIGS. 1 and 2. The racquet 1 is illustrated as a frame only without the strings attached. The racquet 1 has a racquet head 2 connected to a handle 3 by a throat 4 and shaft 5 with the shaft 5 being connected to the handle 3 and two members of the throat 4 being connected between the shaft 5 and the racquet head 2. The handle 3 has a butt 6 at its free end. The racquet head 2 comprises a closed loop frame 7 which has a bridge 8 as a portion of the closed loop frame 7. The bridge 8 forms the portion of the closed loop frame 7 between the connection points of the two members of the throat 4.

The racquet head 2 can be divided into two halves with a top half 9 being remote from the handle 3 with the lower half 10 being closer to the handle 3. The lower half 10 includes the bridge 8. The two halves 9 and 10 can be visualised by identifying the tip 11 or the 12 o'clock position, at the top of the racquet head 2; and the base 12 or 6 o'clock position, at the base of the racquet head 2. By visualising a line drawn between the tip 11 and base 12, and by dividing it into two halves, a 3 o'clock point 13 and a 9 o'clock point 14 can be identified and the two halves 9 and 10 are determined.

A "mid-section" 15 of the racquet 1 is defined as being that section of the racquet 1 which extends between a line between the points 13 and 14 on the one hand and a point 16 which is approximately 20 centimeters up the handle 3 from its free end having the butt 6. Therefore the mid-section 15 of the racquet 1 of the embodiment as illustrated in FIGS. 1 and 2 comprises the lower half 10 of the racquet head 2, the throat 4, the shaft 5 and the bridge 8. It is noted that other tennis racquets (not illustrated) which may have different length handles, such as a racquet which is used by a double handed backhand player, can include a portion of its handle within the mid-section 15.

The tennis racquet 1 of this first preferred embodiment is constructed such that the thickness of the frame of the racquet in its mid-section 15 is less than 12 millimeters. In this particular embodiment as illustrated in FIG. 2, it is seen that all the frame of the mid-section 15 is less than 12 millimeters while the remainder of the frame as contained in the top half 9 of the head 2 and the handle is thicker. Conventional tennis racquets as known in the art have head frame thicknesses of approximately 20 millimeters, while known wide body tennis racquets as known in the art have head frame thicknesses in the range of approximately 20–36 millimeters. The head frame thickness as used in the construction of conventional tennis racquets is illustrated as racquet 1 in the drawings and therefore has a thickness in the top half 9 of the head of approximately 20 millimeters. Therefore the thickness of the mid-section 15 is less than 12 millimeters or approximately 60% of the maximum thickness of the top half 9 of the head 2. This means that the racquet 1 has enough structural strength to be used in the game of tennis, while the thin frame of the mid-section 15 provides the racquet with the desired performance characteristics.

It is noted that even though the embodiment as illustrated in FIGS. 1 and 2, has the entire mid-section 15 with a thickness of less than 12 millimeters and therefore less than 60% of the maximum thickness of the top half 9 of the head 2, it is within the scope of the present invention, for a tennis racquet 1 to have any part of the mid-section 15 having a thickness less than 12 millimeters, as this would accomplish the aims of the invention. It is not necessary for the thickness of the entire mid-section to be less than 12 millimeters or 60% of the maximum thickness of the top half 9 of the head 2.

Figure 3:
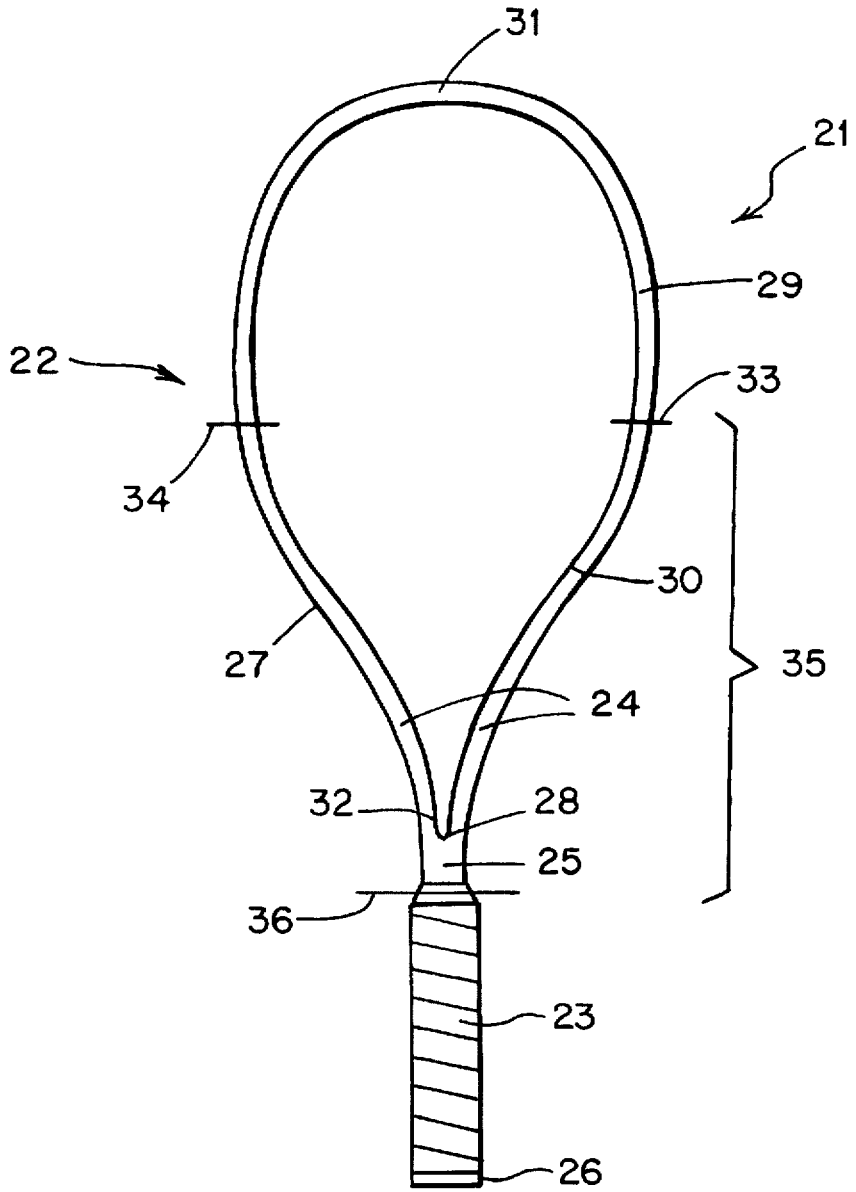
FIG. 3 is a face view of a games racquet of a second embodiment.

A tennis racquet 21 of a second embodiment is illustrated in FIG. 3 as a frame without the strings attached. It is noted that the side view of the racquet 21 is the same as the side view of the first embodiment as illustrated in FIG. 2. The racquet 21 has a racquet head 22, comprising an open loop frame 27 and a throat 24, is connected to a shaft 25 at its top section 28. The shaft 25 in turn connects to a handle 23 which has a butt 26 at its free end. The throat 24 comprises two members which are extensions of the open loop frame 27, and which are joined at the top section 28 of the shaft 25. In this embodiment there is no bridge portion corresponding to the bridge 8 of the first embodiment as the racquet 21 takes the shape of a "tear drop".

Like the first embodiment, the racquet head 22 can be divided into two halves with the top half 29 being remote from the handle 23 with the lower half 30 being closer to the handle 23. The two halves 29 and 30 can be visualised by identifying the tip 31 or the 12 o'clock position, at the top of the racquet head 22; and the base 32 or 6 o'clock position, at the top section 28 of the shaft 25. By visualising a line drawn between the tip 31 and base 32, and by dividing it into two halves, a 3 o'clock point 33 and a 9 o'clock point 34 can be identified and the two halves 29 and 30 are determined. In this embodiment, the lower half includes the throat 24 of the racquet 21.

A "mid-section" 35 of the racquet 21 is defined as being that section of the racquet 21 which extends between a line between the points 33 and 34 on the one hand and a point 36 which is approximately 20 centimeters up the handle 23 from its free end having the butt 26. Therefore the mid-section 35 of the racquet 21 of the embodiment as illustrated in FIG. 3 comprises the lower half 30 of the racquet head 22 (including the throat 24) and the shaft 25. It is noted that other tennis racquets (not illustrated) which may have different length handles, such as a racquet which is used by a double handed backhand player, can include within the mid-section 35 a portion of its handle.

The tennis racquet 21 of this second preferred embodiment is constructed such that the thickness of the frame of the racquet in its mid-section 35 is less than 12 millimeters in a similar manner to the first embodiment, In this particular embodiment, similar to the first embodiment, all the frame of the mid-section 35 has a thickness which is less than 12 millimeters, while the remainder of the frame as contained in the top half 29 of the head 22 and the handle is thicker, and in the case of the head frame thicknesses of the top half 29 of the head 22, is approximately 20 millimeters as described in the previously described embodiment corresponding to a conventional racquet. Therefore the thickness of the mid-section 15 is less than approximately 60% of the maximum thickness of the top half 29 of the head 22. This means that the racquet 21 has enough structural strength to be used in the game of tennis, while the ultra thin flame of the mid-section 35 provides the racquet with the desired performance characteristics.

It is noted that the thickness of the mid-section of the racquets described can be achieved by eliminating much of the frame of the racquet in its mid-section by using lighter and stronger materials such as titanium or titanium/ceramic compounds in the frame of the tennis racquets.

The foregoing describes only some embodiments of the invention and modifications obvious to those skilled in the art can be made thereto without departing from the scope of the present invention.

I claim:

1. A tennis racquet frame, comprising:

a handle having a free end, a racquet head defined by a closed loop frame, a bridge that defines a portion of the closed loop frame of the racquet head, a throat connecting the racquet head to the handle, and the closed loop frame having a first half remote from the handle and a second half being closer to the handle, wherein a mid-section of the racquet extends from and includes the second half of the closed loop frame and the throat, to a point approximately 20 centimeters from the free end of the handle, in which the thickness of the entire mid-section is less than approximately 60% of the maximum thickness of the racquet in the first half of the closed loop frame.

2. The tennis racquet frame of claim 1, wherein the mid-section includes a portion of the handle.

3. The tennis racquet frame of claim 1 or claim 2, wherein the mid-section includes a shaft between the throat and the handle.

* * * * *